US010406044B2

(12) United States Patent
Trepanier et al.

(10) Patent No.: US 10,406,044 B2
(45) Date of Patent: Sep. 10, 2019

(54) PERSON SUPPORT APPARATUSES WITH DRIVE CONTROLS

(71) Applicant: Stryker Corporation, Kalamazoo, MI (US)

(72) Inventors: Jerald A. Trepanier, Kalamazoo, MI (US); Connor Feldpausch St.John, Marne, MI (US); Michael T. Brubaker, Vicksburg, MI (US); Christopher Gentile, Sturgis, MI (US); Gary L. Bartley, Kalamazoo, MI (US)

(73) Assignee: Stryker Corporation, Kalamazoo, MI (US)

( * ) Notice: Subject to any disclaimer, the term of this patent is extended or adjusted under 35 U.S.C. 154(b) by 486 days.

(21) Appl. No.: 15/189,149

(22) Filed: Jun. 22, 2016

(65) Prior Publication Data

US 2016/0374874 A1 Dec. 29, 2016

Related U.S. Application Data

(60) Provisional application No. 62/184,570, filed on Jun. 25, 2015.

(51) Int. Cl.
*A61G 1/02* (2006.01)
*A61G 1/04* (2006.01)
(Continued)

(52) U.S. Cl.
CPC ..... *A61G 1/0275* (2013.01); *A61G 1/0281* (2013.01); *A61G 1/0293* (2013.01);
(Continued)

(58) Field of Classification Search
CPC .. A61G 1/0275; A61G 7/0516; A61G 1/0293; A61G 13/104; A61G 7/015;
(Continued)

(56) References Cited

U.S. PATENT DOCUMENTS 5,366,036 A * 11/1994 Perry ..... A61G 5/006 180/65.1
5,580,207 A * 12/1996 Kiebooms ..... A61G 7/08 180/19.2
(Continued)

FOREIGN PATENT DOCUMENTS

CA 2497082 A1 6/2006
EP 2208487 A2 7/2010
(Continued)

OTHER PUBLICATIONS

European Search Report for EP16175940, the European counterpart to U.S. Appl. No. 15/189,149.

*Primary Examiner* — Nicholas F Polito
*Assistant Examiner* — Alexis Felix Lopez
(74) *Attorney, Agent, or Firm* — Warner Norcross + Judd LLP

(57) ABSTRACT

A person support apparatus includes a base, wheels, a drive system, a support surface, a lift system, and a control. The control controls the drive system in response to forward/reverse forces applied thereto, and also controls the lift system in response to upward or downward forces applied thereto. In some embodiments, a controller compares a magnitude of the forward/reverse force to a magnitude of the upward/downward force and commands the drive system to drive the wheels if the magnitude of the forward/reverse force exceeds the magnitude of the upward/downward force. The control may include a user-engageable portion that is constructed to not move with respect to a force sensor when forward or reverse forces are applied to the user-engageable portion. The controller controls the drive system in response to the forward or reverse forces applied to the user-engageable portion.

23 Claims, 11 Drawing Sheets

(51) Int. Cl.

| | |
|---|---|
| ***A61G 1/048*** | (2006.01) |
| ***A61G 7/012*** | (2006.01) |
| ***A61G 7/018*** | (2006.01) |
| ***A61G 7/08*** | (2006.01) |
| ***A61G 7/015*** | (2006.01) |
| ***A61G 7/05*** | (2006.01) |
| ***A61G 13/08*** | (2006.01) |
| ***A61G 13/10*** | (2006.01) |

(52) U.S. Cl.
CPC ..... *A61G 1/04* (2013.01); *A61G 1/048* (2013.01); *A61G 7/012* (2013.01); *A61G 7/015* (2013.01); *A61G 7/018* (2013.01); *A61G 7/0507* (2013.01); *A61G 7/0516* (2016.11); *A61G 7/08* (2013.01); *A61G 13/08* (2013.01); *A61G 13/104* (2013.01); *A61G 1/0218* (2013.01); *A61G 1/0237* (2013.01); *A61G 2203/32* (2013.01)

(58) Field of Classification Search
CPC ..... A61G 7/0507; A61G 13/08; A61G 1/04; A61G 1/0281; A61G 7/08; A61G 7/018; A61G 7/012; A61G 1/048; A61G 1/0237; A61G 2203/32; A61G 1/0218
See application file for complete search history.

(56) References Cited

U.S. PATENT DOCUMENTS

| | | | | |
|---|---|---|---|---|
| 5,927,423 | A | 7/1999 | Wada et al. | |
| 6,062,328 | A * | 5/2000 | Campbell | B62B 5/0026 180/216 |
| 6,070,679 | A * | 6/2000 | Berg | B62B 3/1404 180/19.2 |
| 6,076,208 | A * | 6/2000 | Heimbrock | A61G 7/00 5/183 |
| 6,834,402 | B2 * | 12/2004 | Hanson | A61G 7/1026 180/209 |
| 7,481,286 | B2 * | 1/2009 | Ruschke | A61G 7/08 180/11 |
| 7,789,187 | B2 * | 9/2010 | Zerhusen | A61G 7/05 180/19.1 |
| 8,196,944 | B1 | 6/2012 | Vondrak | |
| 8,474,073 | B2 | 7/2013 | Hamberg et al. | |
| 8,605,053 | B2 | 12/2013 | Murphy et al. | |
| 8,984,685 | B2 * | 3/2015 | Robertson | A61G 7/018 5/611 |
| 2003/0009825 | A1 | 1/2003 | Gallant et al. | |
| 2005/0236208 | A1 | 10/2005 | Runkles et al. | |
| 2008/0084175 | A1 * | 4/2008 | Hollis | B25J 5/007 318/568.12 |
| 2008/0086815 | A1 * | 4/2008 | Kappeler | A61G 7/018 5/600 |
| 2008/0141459 | A1 * | 6/2008 | Hamberg | A61G 7/018 5/600 |
| 2008/0172789 | A1 * | 7/2008 | Elliot | G06F 19/00 5/616 |
| 2008/0289108 | A1 * | 11/2008 | Menkedick | A61G 7/0528 5/610 |
| 2011/0083270 | A1 * | 4/2011 | Bhai | B60L 3/10 5/600 |
| 2011/0087416 | A1 * | 4/2011 | Patmore | A61G 1/048 701/93 |
| 2012/0117730 | A1 * | 5/2012 | Lemire | A61G 1/0268 5/611 |
| 2013/0219382 | A1 * | 8/2013 | Parsons | G01G 19/445 717/173 |
| 2013/0283529 | A1 * | 10/2013 | Hayes | A61G 7/018 5/600 |
| 2014/0041119 | A1 * | 2/2014 | Thodupunuri | A61G 7/08 5/510 |
| 2014/0076644 | A1 * | 3/2014 | Derenne | A61G 7/012 180/19.2 |
| 2014/0150806 | A1 * | 6/2014 | Hu | A61B 5/0002 128/870 |
| 2014/0165290 | A1 * | 6/2014 | Koors | A61G 7/08 5/611 |
| 2014/0215717 | A1 * | 8/2014 | Rigsby | A61G 7/002 5/613 |
| 2015/0342809 | A1 * | 12/2015 | Doppler | A61G 7/012 5/611 |
| 2015/0378514 | A1 * | 12/2015 | Keski-Jaskari | H03K 17/964 345/178 |
| 2016/0106608 | A1 * | 4/2016 | Oh | A61G 7/103 5/81.1 C |
| 2016/0128880 | A1 * | 5/2016 | Blickensderfer | A61G 1/0212 |
| 2016/0143796 | A1 * | 5/2016 | Jordan | A61G 1/0275 701/70 |
| 2016/0151220 | A1 * | 6/2016 | Hinton | A61G 13/02 5/600 |
| 2016/0193095 | A1 * | 7/2016 | Roussy | A61G 7/002 5/11 |
| 2016/0213536 | A1 * | 7/2016 | Madsen | A61G 7/018 |
| 2017/0281441 | A1 * | 10/2017 | Fich | A61G 7/08 |

FOREIGN PATENT DOCUMENTS

| | | | |
|---|---|---|---|
| JP | 2000016298 | A | 1/2000 |
| WO | 2005041837 | A2 | 5/2005 |
| WO | 2007121376 | A2 | 10/2007 |
| WO | 2012055407 | A1 | 5/2012 |

* cited by examiner

PERSON SUPPORT APPARATUSES WITH DRIVE CONTROLS

CROSS REFERENCE TO RELATED APPLICATIONS

This application claims priority to U.S. provisional patent application Ser. No. 62/184,570 filed Jun. 25, 2015, by inventors Jerald Trepanier et al. and entitled PERSON SUPPORT APPARATUSES WITH DRIVE CONTROLS, the complete disclosure of which is hereby incorporated herein by reference.

BACKGROUND OF THE INVENTION

The present disclosure relates to person support apparatuses, such as beds, cots, stretchers, operating tables, recliners, or the like.

Modern health care facilities utilize a wide variety of person support apparatuses. Examples of such person support apparatuses include beds, stretchers, cots, surgery tables, wheelchairs, recliners, and other types of apparatuses that are designed to help support a patient. Most of these apparatuses include one or more wheels that enable them to be pushed throughout different areas of a health care facility, such as a hospital, a nursing home, an assisted living center, or other environments where such person support apparatuses are used. In some prior art versions, the person support apparatuses have included a propulsion system having one or more motors that drive one or more of the wheels and thereby propel the person support apparatus. Such propulsion systems ease the force that caregivers and other personnel must exert on the person support apparatus when the apparatus is moved to different locations.

SUMMARY OF THE INVENTION

According to various embodiments, the present disclosure provides a person support apparatus having one or more improved controls that allow a caregiver, or other user, to more efficiently use the person support apparatus. For example, in at least one embodiment, the person support apparatus includes one or more controls that can be manipulated to not only control the propulsion system of the person support apparatus, but also to control a lift system of the person support apparatus. The lift system changes the height of a support surface on the person support apparatus, as well as the height of the control. The caregiver can therefore use the control to change the height of the control such that it is at a comfortable height during the transport of the person support apparatus, and then return the control to its previous height after the transport is complete, all without requiring the user to move around to a side or foot end of the person support apparatus to make such height changes. Still further, in some embodiments, the controls include enable switches that must be activated before the lift and/or propulsion system can be controlled. Still other features are included in the additional embodiments discussed below.

In one embodiment, a person support apparatus is provided that includes a base, wheels, a drive system, a support surface, a lift system, and a control. The drive system is coupled to at least one of the wheels and drives the person support apparatus in a forward or reverse direction. The support surface is adapted to support thereon an occupant of the person support apparatus. The lift system moves the support surface upward and downward with respect to the base. The control is in communication with the drive system and the lift system, and is adapted to control the drive system in response to forward forces applied to the control, and to control the lift system in response to upward or downward forces applied to the control.

In some embodiments, the person support apparatus includes a litter mounted on top of the lift system such that the lift system moves the litter upward and downward with respect to the base. The support surface is mounted on top of the litter, and the control includes a handle positioned on the litter. The handle moves upward and downward with the litter.

The control, in some embodiments, only controls the lift system in response to the upward or downward forces at times when the drive system is not driving the wheels.

The person support apparatus may further include a first enable switch that must be activated before the drive system will respond to the forward or reverse forces applied to the control, as well as a second enable switch that must be activated before the lift system will respond to the upward or downward forces applied to the control. In some embodiments, the first and second enable switches are combined into a single enable switch that enables both forward and reverse movement, as well as both upward and downward movement. The first and second enable switches are mounted on the handle, in some embodiments, such that a user can simultaneously touch both the first and second enable switches while gripping the handle.

The person support apparatus may include a control panel positioned along at least one of the sides of the person support apparatus that includes buttons for raising and lowering the litter. In one embodiment, the buttons of the side control panel are always activated, regardless of the state of the first and second enable switches. In another embodiment, the buttons of the side control panel are deactivated anytime that the enable switch for the propulsion system is activated.

In some embodiments, the control includes a right handle and a left handle, and the person support apparatus further includes a first enable switch and a second enable switch mounted to the right handle, and a third enable switch and a fourth enable switch mounted to the left handle. The first or third enable switch must be activated before the drive system will respond to forward or reverse forces applied to either of the right or left handles, and the second or fourth enable switch must be activated before the lift system will respond to upward or downward forces applied to either of the right or left handles.

The person support apparatus may also include a plurality of siderails coupled to the litter and a plurality of siderail sensors that detect if a corresponding one of the siderails is in a raised position or a lowered position. The lift system is configured in some embodiments to not respond to upward or downward forces applied to the control unless all of the siderail sensors indicate that all of the siderails are in their raised positions.

A timer is included in some embodiments of the person support apparatus that is adapted to start counting when the drive system stops driving the person support apparatus. The lift system is configured to not respond to the upward or downward forces applied to the control until after the timer reaches a threshold.

In some embodiments, the control includes a single load cell that is adapted to detect all of the forward, reverse, upward, and downward forces.

The movement of the support surface up or down by the lift system is undertaken, in some embodiments, at a constant speed in response to upward or downward forces applied to the control, regardless of the magnitude of those upward or downward forces. The drive system, in contrast, drives at least one of the wheels in a manner that varies with a magnitude of the forward or reverse forces applied to the control.

According to another embodiment, a person support apparatus is provided that includes a base, wheels, a drive system, a support surface, a lift system, a controller, and a user interface. The drive system is coupled to at least one of the wheels and drives the person support apparatus in a forward or reverse direction. The support surface is adapted to support thereon an occupant of the person support apparatus. The lift system changes the height of the support surface. The controller communicates with the drive system and the lift system. The user interface communicates with the controller and is adapted to allow a user to control the lift system and the drive system. The controller prevents the lift system from changing the height of the support surface while the drive system is driving any of the wheels.

In some embodiments, the controller also prevents the drive system from driving the person support apparatus while the lift system is changing the height of the support surface. The person support apparatus may also include a control adapted to drive the drive system in response to forward or reverse forces applied to the control, and to control the lift system in response to upward or downward forces applied to the control.

The controller is configured, in some embodiments, to compare a magnitude of the forward or reverse forces applied to the control to a magnitude of the upward or downward forces applied to the control. The controller drives the drive system if the magnitude of the forward or reverse forces is greater than the magnitude of the upward or downward forces, and the controller drives the lift system if the magnitude of the upward or downward forces is greater than the magnitude of the forward or reverse forces.

In some embodiments, the controller does not switch from driving the lift system to driving the drive system until a predetermined amount of time passes after the lift system stops being driven. Similarly, the controller does not switch from driving the drive system to driving the lift system until a predetermined amount of time passes after the drive system stops being driven. The two predetermined amounts of time may differ or be the same.

According to another embodiment, a person support apparatus is provided that includes a base, wheels, a drive system, a support surface, a lift system, a controller, a control, a lift enable switch, and a drive enable switch. The drive system is coupled to at least one of the wheels and drives the person support apparatus in a forward or reverse direction. The support surface is adapted to support thereon an occupant of the person support apparatus. The lift system changes the height of the support surface. The controller communicates with the drive system, the lift system, and the control. The control is for controlling both the lift system and the drive system. The lift enable switch enables the control to control the lift system when the lift enable switch is activated, and the drive enable switch enables the control to control the drive system when the drive enable switch is activated. The controller is programmed to allow only one of the lift enable switch and the drive enable switch to be activated at a time.

In some embodiments, both the lift enable switch and the drive enable switch are adapted to be pressed by a user. The controller activates the lift enable switch when the user presses on the lift enable switch if the user is not also concurrently pressing on the drive enable switch, and the controller activates the drive enable switch when the user presses on the drive enable switch if the user is not also concurrently pressing on the lift enable switch.

According to another embodiment, a person support apparatus is provided that includes a base, wheels, a drive system, a support surface, a lift system, a controller, and a control. The drive system is coupled to at least one of the wheels and drives the person support apparatus in a forward or reverse direction. The support surface is adapted to support thereon an occupant of the person support apparatus. The lift system changes the height of the support surface. The controller communicates with the drive system, the lift system, and the control. The control is adapted to detect forward forces, upward forces, and downward forces applied to the control. The controller compares a magnitude of an applied forward force to a magnitude of an applied upward or downward force and commands the drive system to drive the person support apparatus if the magnitude of the applied forward force exceeds the magnitude of the applied upward or downward force.

In some embodiments, the controller commands the lift system to change a height of the support surface if the magnitude of the applied upward or downward force exceeds the magnitude of the applied forward force.

The person support apparatus is one of a bed or a stretcher, in some embodiments.

Before the various embodiments disclosed herein are explained in detail, it is to be understood that the claims are not to be limited to the details of operation or to the details of construction and the arrangement of the components set forth in the following description or illustrated in the drawings. The embodiments described herein are capable of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the claims to any specific order or number of components. Nor should the use of enumeration be construed as excluding from the scope of the claims any additional steps or components that might be combined with or into the enumerated steps or components.

DETAILED DESCRIPTION OF THE EMBODIMENTS

Figure 1:
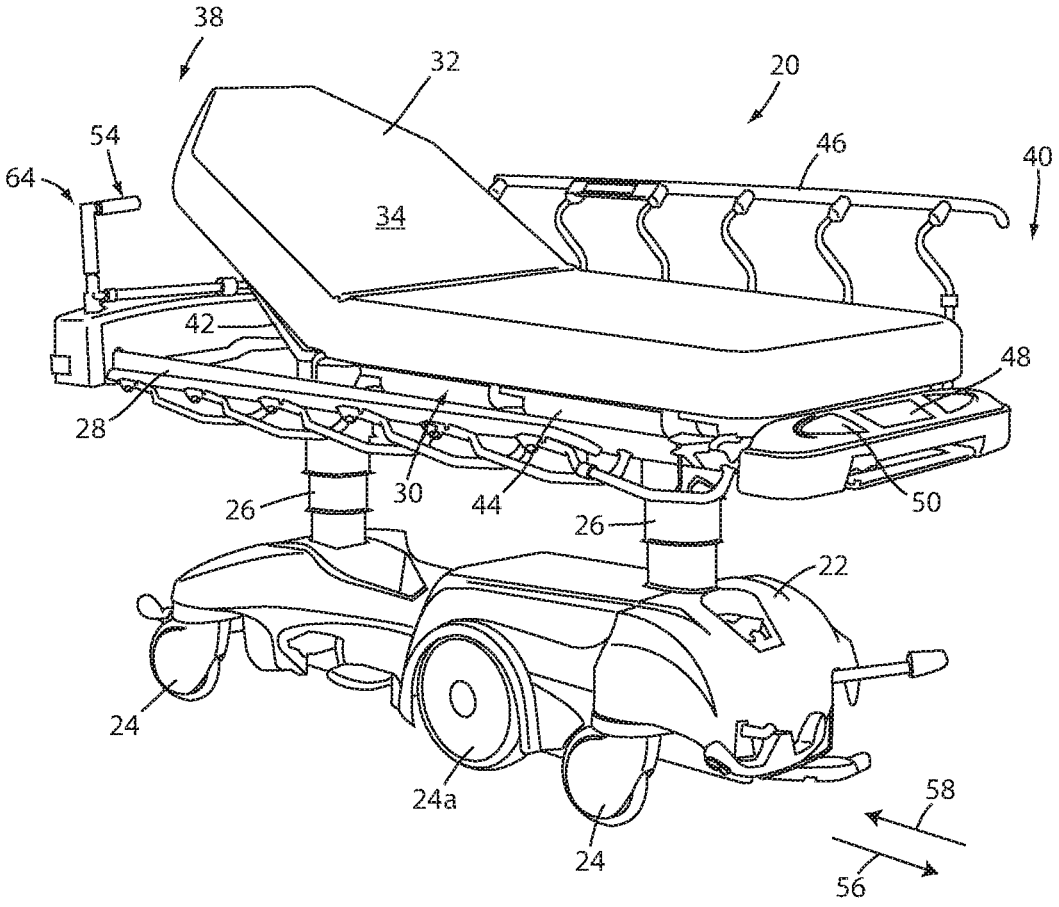
FIG. 1 is a perspective view of a person support apparatus according to a first embodiment.

A person support apparatus 20 according to one embodiment is shown in FIG. 1. Person support apparatus 20, as shown in FIG. 1, is implemented as a stretcher. It will be understood, however, that person support apparatus 20 can be alternatively implemented as a bed, a cot, a recliner, or other apparatus that is capable of supporting a person.

Figure 2:
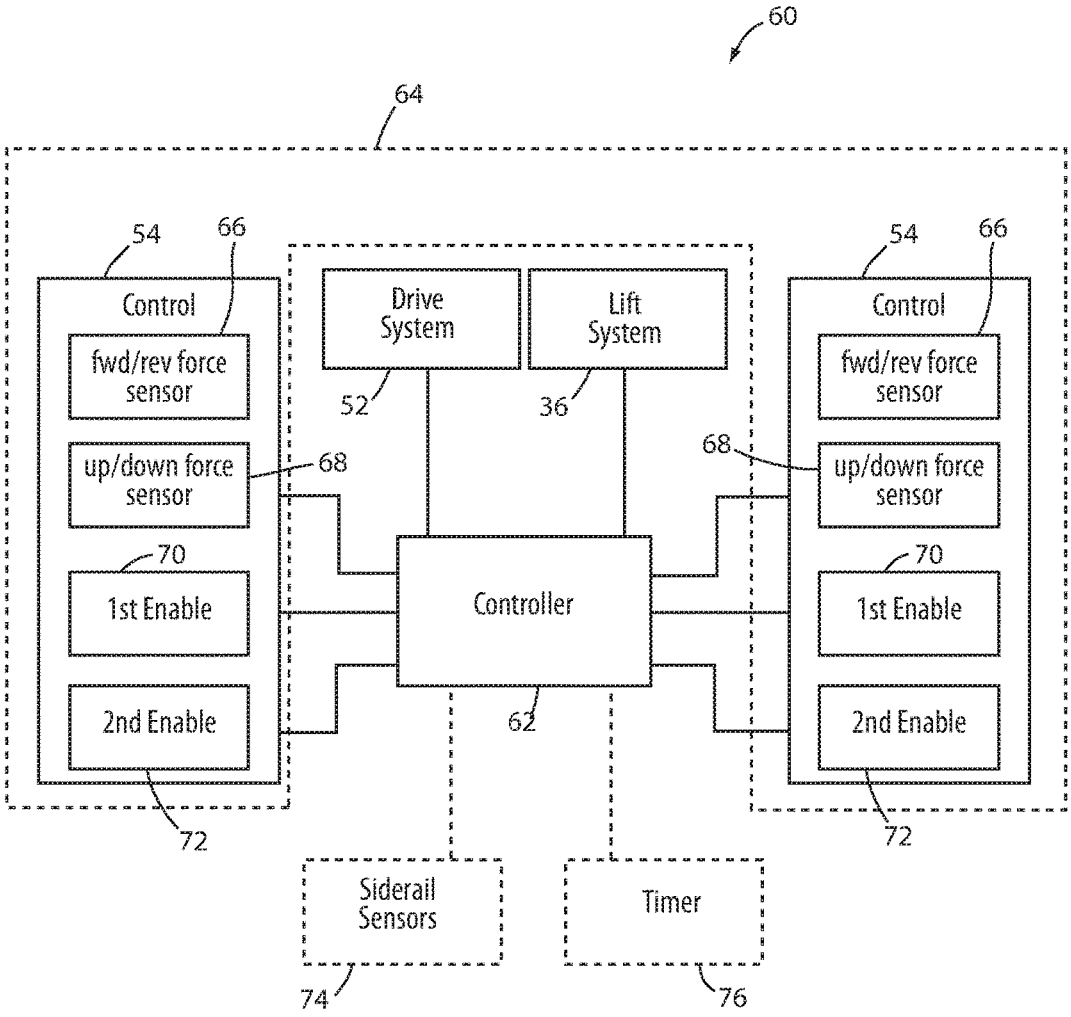
FIG. 2 is a block diagram of a first embodiment of a control system usable with the person support apparatus of FIG. 1.

Person support apparatus 20 of FIG. 1 includes a base 22 having a plurality of wheels 24, a pair of lifts 26 supported on the base, a frame or litter 28 supported by the lifts 26, and a deck 30 that is supported on top of litter 28. Lifts 26 are adapted to raise and lower frame 28 and deck 30 with respect to base 22. Lifts 26 may include a combination of hydraulic actuators and electric actuators, or they may be entirely electric. As will be discussed in greater detail below, lifts 26 are part of a lift system 36 that is integrated into person support apparatus 20 and that may be controlled by one or more controllers 54 (FIG. 2). Deck 30 supports a mattress 32, or other cushioning device, on which a patient may sit or lie. A top side of mattress 32 provides a support surface 34 for the patient. The patient typically lies on mattress 32 such that his or her head is positioned adjacent a head end 38 of person support apparatus 20 and his or her feet are positioned adjacent a foot end 40 of person support apparatus 20.

Support deck 30 is made of a plurality of sections, some of which are pivotable about generally horizontal pivot axes. In the embodiment shown in FIG. 1, support deck 30 includes an upper or head section 42 and a lower or foot section 44. Head section 42, which is also sometimes referred to as a Fowler section, is pivotable between a generally horizontal orientation (not shown in FIG. 1) and a plurality of raised positions (one of which is shown in FIG. 1).

A plurality of side rails 46 (FIG. 1) may also be coupled to frame 28. If person support apparatus 20 is a bed, there may be four such side rails, one positioned at a left head end of frame 28, a second positioned at a left foot end of frame 28, a third positioned at a right head end of frame 28, and a fourth positioned at a right foot end of frame 28. If person support apparatus 20 is a stretcher, such as shown in FIG. 1, or a cot, there may be fewer side rails, such as one siderail 46 on each side of person support apparatus 20. In other embodiments, there may be no side rails on person support apparatus 20. Regardless of the number of side rails, such side rails are movable between a raised position in which they block ingress and egress into and out of person support apparatus 20, and a lowered position in which they are not an obstacle to such ingress and egress.

The construction of any of base 22, lifts 26, frame 28, support deck 30, and/or side rails 46 may take on any known or conventional design, such as, for example, those disclosed in commonly assigned, U.S. Pat. No. 7,395,564 issued to McDaniel et al. and entitled ARTICULATED SUPPORT SURFACE FOR A STRETCHER OR GURNEY, or commonly assigned U.S. Pat. No. 6,230,343 issued to Buiskool et al. and entitled UNITARY PEDAL CONTROL FOR HEIGHT OF A PATIENT SUPPORT, the complete disclosures of both of which are incorporated herein by reference. The construction of any of base 22, lifts 26, frame 28, support deck 30, and/or the side rails 46 may also take on forms different from what is disclosed in the aforementioned patents.

Person support apparatus 20 also includes a control panel 48 positioned at foot end 40 of support deck 30 (FIG. 1). Control panel 48 includes a plurality of buttons 50 and/or other controls that allow a user to control various of the powered and/or electronic functions of person support apparatus 20. For example, control panel 48 allows a user to control lifts 26 in order to change the height of support deck 30. Control panel 48 may also include controls for controlling an exit detection system, or for controlling still other functions.

Person support apparatus 20 further includes at least one powered wheel **24*a* that is selectively driven by a drive system 52 (FIG. 2) having one or more motors (not shown). Drive system 52 is integrated into person support apparatus 20 and reduces the amount of force required by a caregiver to push person support apparatus 20 from one location to another. A pair of controls 54 (only one visible in FIG. 1) are positioned at head end 38 of person support apparatus 20 and are used to control the driven wheel. As will be discussed in greater detail below, when a user pushes in a forward direction 56 or a reverse direction 58 on one or both of controls 54, the drive system 52 drives one or more of the wheels 24 such that the person support apparatus 20 moves in the forward or reverse direction 56 or 58**. Further details of a drive system that may be used with the persons support apparatuses disclosed herein are disclosed in commonly assigned U.S. Pat. No. 6,772,850, issued to Waters et al. and entitled POWER ASSISTED WHEELED CARRIAGES, as well as U.S. patent publication 2014/0076644 published Mar. 20, 2014 by inventors Richard Derenne et al. and entitled POWERED PATIENT SUPPORT APPARATUS, the complete disclosures of which are both hereby incorporated herein by reference.

FIG. 2 illustrates in greater detail a first embodiment of a control system 60 that may be incorporated into person support apparatus 20. Control system 60 includes a controller 62 that is in communication with a user interface 64 that is used to control the drive system 52 and the lift system 36 of person support apparatus 20. Drive system 52, as noted previously, includes one or more motors that are used to drive one or more driven wheels **24*a*. Lift system 36, as also noted previously, includes one or more actuators for powering lifts 26, which raise and lower litter frame 28 with respect to base 22**.

Controller 62 is a microcontroller, in at least one embodiment. It will be understood, however, the controller 62 may take on other forms. In general, controller 62 may include any one or more microprocessors, microcontrollers, field programmable gate arrays, systems on a chip, volatile or nonvolatile memory, discrete circuitry, and/or other hardware, software, or firmware that is capable of carrying out the functions described herein, as would be known to one of ordinary skill in the art. Such components can be physically configured in any suitable manner, such as by mounting them to one or more circuit boards, or arranging them in other manners, whether combined into a single unit or distributed across multiple units. The instructions followed by controller 62 in carrying out the functions described herein, as well as the data necessary for carrying out these functions, are stored in a memory (not labeled) accessible to controller 62.

User interface 64 is positioned at head end 38 of person support apparatus 20 and includes controls 54. In the embodiment shown in FIG. 2, each control 54 includes a forward/reverse force sensor 66 and an up/down force sensor 68. Each control 54 also includes a first enable switch 70 and a second enable switch 72. The outputs of the forward/reverse force sensors 66, the up/down force sensors 68, and the first and second enables switches 70 and 72 are all fed to controller 62, which in turn sends commands to drive system 52 and lift system 36. In some embodiments, controller 62 may also be in communication with a plurality of siderail sensors 74 that detect whether siderails 46 are in the up or down position and relay that information to controller 62. In some embodiments, controller 62 may also be in communication with a timer 76 that it uses in controlling the drive and lift systems 52 and 36, as will be discussed in greater detail below. Siderail sensors 74 and timer 76 are shown in dashed lines in the embodiment of control system 60 shown in FIG. 1 to indicate the optional nature of their presence in control system 60.

In contrast to prior art controls that have been used to control an on-board drive system of a person support apparatus, controls 54 of person support apparatus 20 are adapted to also control lift system 36. A user can therefore change the height of litter 28 using the same controls 54 that the user uses to drive person support apparatus 20 to different locations. This allows the user to adjust the height of controls 54 (using controls 54 themselves), thereby enabling him or her to move the controls 54 to a height that is comfortable for controlling the drive system 52. This avoids requiring the user to walk to a separate control panel (e.g. control panel 48) that is not positioned at head end 38 of person support apparatus 20 in order to change the height of litter 28 (and controls 54, which are coupled to litter 28).

First enable switch 70 is used to enable and disable the control of drive system 52. That is, before a user can use control 54 to control the drive system 52, the user must activate first enable switch 70. In some embodiments, as will be discussed more below, first enable switch 70 is a button that must be pushed in order to enable drive system 52. First enable switch 70, however, can be physically implemented in other forms.

When first enable switch 70 is activated (such as by pressing), it sends a signal to controller 62. Controller 62 responds to the signal by allowing any forward or reverse forces applied to control 54, and detected by forward/reverse force sensor 66, to be used to control drive system 52. If controller 62 does not receive an activation signal from first enable switch 70, it will not allow any forward or reverse signals it receives from forward/reverse force sensor 66 to be used to control drive system 52. As a result, the pushing or pulling on controller 54 in a forward or reverse direction by a user who has not also activated first enable switch 70 will not result in any control of drive system 52, and person support apparatus 20 will not move in a powered manner in response to such pushing or pulling by the user. Still further, when a user initially activates first enable switch 70 and begins driving person support apparatus 20 using control 54, but then deactivates first enable switch 70 while the person support apparatus 20 is still moving, controller 62 will terminate power to drive system 52 (and, in some cases, bring person support apparatus 20 to a complete stop before allowing the person support apparatus to be manually pushed or pulled).

Second enable switch 72 works in a manner similar to first enable switch 70, but is used to enable and disable the control of lift system 36 by controls 54, rather than the control of drive system 52. That is, before a user can use control 54 to control lift system 36, the user must activate second enable switch 72. In some embodiments, as will be discussed more below, second enable switch 72 is a button that must be pushed in order to enable lift system 36. Second enable switch 72, however, can be physically implemented in other forms.

When second enable switch 72 is activated (such as by pressing), it sends a signal to controller 62. Controller 62 responds to the signal by allowing any upward or downward forces applied to control 54, and detected by upward/downward force sensor 68, to be used to control lift system 36. If controller 62 does not receive an activation signal from second enable switch 72, it will not allow any upward or downward force signals it receives from upward/downward force sensor 68 to be used to control lift system 36. As a result, the pushing or pulling on control 54 in an upward or downward direction by a user who has not also activated second enable switch 72 will not result in any control of lift system 36, and litter frame 28 will not change its height in response to such pushing or pulling by the user. Still further, when a user initially activates second enable switch 72 and begins changing the height of litter frame 28 using control 54, but then deactivates second enable switch 72 while the litter frame 28 is still moving, controller 62 will terminate power to lift system 36 and stop the lifting or lowering of litter frame 28.

Control system 60 includes two controls 54 that each has their own associated first and second enable switches 70 and 72. In one embodiment of control system 60, it is only necessary for a user to press (or otherwise activate) a single one of the two enable switches 70, or a single one of the two enable switches 72, in order to enable the control 54 to control drive system 52 or lift system 36, respectively. In other words, it is not necessary for a user to activate both of the first enable switches 70 in order to use control 54 to control drive system 52, nor is it necessary for a user to activate both of the second enable switches 72 in order to use control 54 to control lift system 36.

In at least one embodiment, the activation of either or both of enable switches 70 and 72 on a first control 54 allows the user to control the respective drive or lift system 52 or 36 using the other control 54, even if the associated enable switches of that other control 54 have not been activated. In still other embodiments, the enable switches 70 and 72 only enable the control of drive or lift system 52 or 36 by that associated control such that, for example, activating enable switches 70 or 72 on a left control 54 would not allow the user to use a right control 54 to control drive or lift system 52 or 36 unless the user activated the switches 70 or 72 on the right control 54 as well.

Controller 62 is programmed differently to control the activation of drive and lift systems 52 and 36 in different manners. In a first embodiment, controller 62 is programmed to allow drive system 52 and lift system 36 to be simultaneously controlled by one or both of controls 54. When programmed in this manner, a user is able to change the height of litter 28 using control 54 while the user is also simultaneously using the control 54 to control drive system 52. Thus, the height of litter 28 may be changed while person support apparatus 20 is in motion.

In a second embodiment, controller 62 is programmed to only allow one of drive system 52 and lift system 36 to be controlled at the same time using controls 54. In this second embodiment, controller 62 determines which one of the two systems (drive system 52 and lift system 36) to control based upon whichever one of the enable switches 70 and 72 is activated first. That is, if a user activates first enable switch 70 prior to activating second enable switch 72, the user will be able to use control 54 to drive person support apparatus 20, but any upward or downward forces applied to control 54 will not result in upward or downward movement of litter 28, despite the fact that the second enable switch 72 is activated. Similarly, if a user activates second enable switch 72 prior to activating first enable switch 70, the user will be able to use control 54 to change the height of litter 28, but any forward or reverse forces applied to control 54 will not result in person support apparatus 20 being driven forward or backward.

Regardless of whether or not controller 62 allows only one of drive and lift systems 52 and 36 to be controlled by a control 54 at a time, or whether it allows a control 54 to control them simultaneously, controller 62 is configured, in at least one embodiment, to control the drive system 52 in a manner that varies in relation to the amount of forward or reverse force applied to control 54 (as detected by forward/reverse force sensor 66), and to control lift system 36 in a manner that does not vary in relation to the amount of upward or downward force applied to control 54 (as detected by upward/downward force sensor 68). In such an embodiment, the harder a user pushes in a forward direction 56 on control 54, the faster controller 62 generally drives person support apparatus 20 in the forward direction, and the harder a user pulls on control 54 in a reverse direction 58, the faster controller 62 generally drives person support apparatus 20 in the reverse direction. In contrast, controller 62 is programmed, in such an embodiment, to change the height of litter 28 at a substantially constant speed irrespective of the amount of upward or downward force that is applied to a control 54 (and sensed by up/down force sensors 68).

In an alternative embodiment, the speed of the height adjustment is progressively increased according to the magnitude of the upward or downward force applied to control 54. Such an alternative embodiment is particularly useful when person support apparatus 20 is a cot used in providing emergency medical services, although such an embodiment can also be used with other forms of person support apparatus 20.

When controller 62 is programmed to disallow control 54 from simultaneously controlling both drive system 52 and lift system 36, it will be understood that controller 62, in at least one embodiment, is programmed to only disallow move commands that are detected by controls 54. In other words, in such embodiments, move commands that are entered by another user interface besides user interface 64 (such as control panel 48) are not affected by the actions of controller 62 in restricting drive system 52 or lift system 36 with respect to controls 54. As a result, for example, if a user is pushing forward on one of the controls 54 (while first enable switch 70 is activated) and person support apparatus 20 is thus being driven forward by drive system 52, it is still possible for a user to change the height of litter 28 by utilizing an appropriate button 50 or other control on control panel 48. In such a situation, controller 62 only prevents controls 54 from being used to change the height of litter 28.

Figure 3:
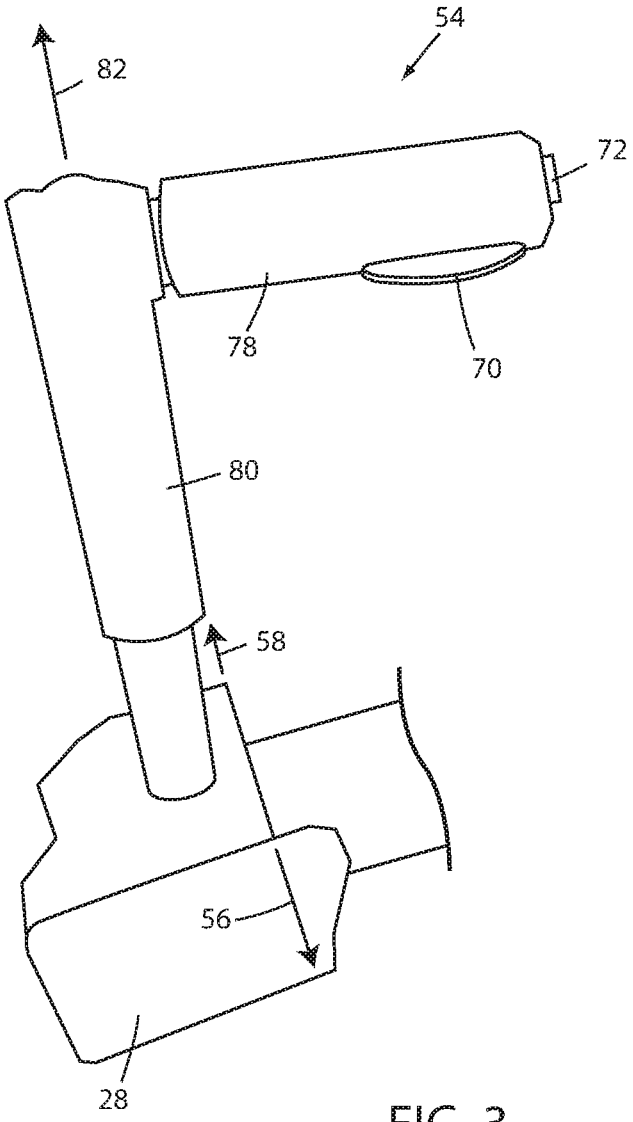
FIG. 3 is a perspective view of an illustrative embodiment of one of the controls of the control system of FIG. 2.

FIG. 3 shows an enlarged view of one of the controls 54 of FIG. 1, and represents an example of one manner in which a first one of the controls 54 of control system 60 can be physically implemented on person support apparatus 20. It will be understood that a second one of the controls 54 of control system 60 is constructed as a mirror image of the control 54 shown in FIG. 3 and positioned at an opposite one of the corners of person support apparatus 20. That is, control 54 of FIG. 3 is positioned in a first one of the corners at head end 38 of person support apparatus 20, and the mirror-image control 54 is positioned in the second one of the corners at head end 38.

As shown in FIG. 3, control 54 includes a handle 78 coupled to a post 80 which is, in turn, coupled to litter 28. Post 80 generally extends upward from litter 28 in a vertical direction 82. Handle 78 is coupled to post 80 at a substantially right angle. Handle 78 therefore includes an internal longitudinal axis that is substantially horizontal (if person support apparatus 20 is on a horizontal floor). First enable switch 70 is positioned on handle 78 and is activated when pressed by a user, thereby allowing a user to drive person support apparatus 20 in a forward or reverse direction when the user pushes or pulls on handle 78 in a forward or reverse direction 56 or 58. Second enable switch 72 is also positioned on handle 78 at a distal end of handle 78 and is activated when the user pushes inwardly on switch 72 (i.e. in a direction parallel to the longitudinal axis of handle 78 and toward post 80). When a user pushes enable switch 72 sufficiently in this direction, controller 62 allows a user to raise and lower litter 28 by lifting upwardly or pushing downwardly on handle 78.

Figure 4:
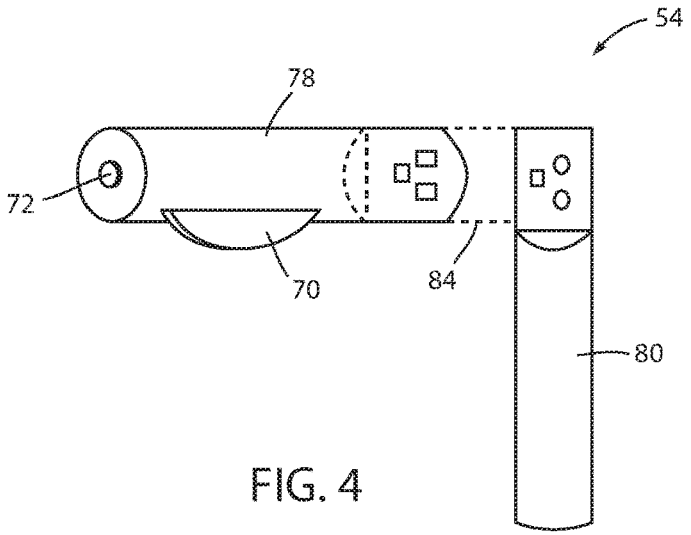
FIG. 4 is an elevation view of the control of FIG. 3 shown configured in a first manner with a load cell positioned between a handle and a post.
Figure 5:
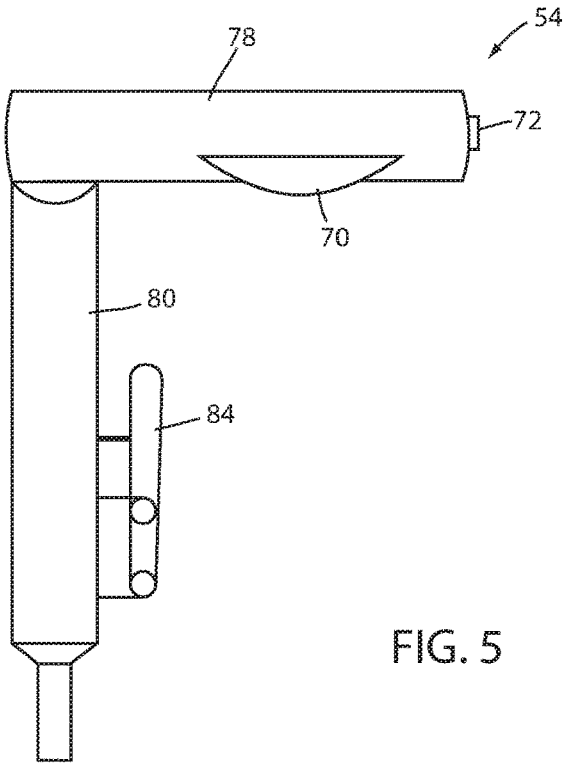
FIG. 5 is an elevation view of the control of FIG. 3 shown configured in a second manner with the load cell positioned between the post and a fixed location on a litter frame of the person support apparatus.

In the embodiment of control 54 shown in FIG. 3, post 80 is rigidly coupled to litter 28 such that when a user exerts an upward, downward, forward, or reverse force on handle 78, post 80 does not move. The application of these forces to handle 78 is detected by up/down force sensor 68 or forward/reverse force sensor 66, which are positioned internally to handle 78. The construction of the force sensors 66 and 68 can vary widely, as well as their location within handle 78. FIG. 4 illustrates one manner in which force sensors 66 and 68 can be constructed within handle 78, while FIG. 5 illustrates one manner in which force sensors 66 and 68 can be constructed externally of handle 78. Still other designs and locations for force sensors 66 and 68 can be used.

FIG. 4 illustrates in greater detail one manner in which force sensors 66 and 68 may be constructed within handle 78. In the embodiment of FIG. 4, a single load cell 84 (shown in dashed lines) detects both vertical and horizontal (i.e. forward and reverse) forces applied to handle 78. That is, in the embodiment shown in FIG. 4, forward/reverse force sensor 66 and upward/downward force sensor 68 are combined into a single sensor (load cell 84) that is able to detect both types of forces. Load cell 84 is coupled at a first end to post 80 and at a second end to handle 78 and forms the physical connection between post 80 and handle 78. Forces exerted on handle 78 (up/down and forward/reverse) therefore create a strain on load cell 84 that is measured by the internal strain gauges of load cell 84. These measurements are forwarded to controller 62 which processes them. In at least one embodiment, load cell 84 includes separate strain gauges for the up/down forces and the forward/reverse forces and sends separate outputs of these force components to controller 62. In another embodiment, load cell 84 combines the outputs of the strain gauges together and sends only a single output to controller 62. In this latter embodiment, controller 62 reacts to the output from load cell 84 as either a control signal for the drive system 52 if first enable switch 70 has been activated, or as a control signal for the lift system 36 if the second enable switch 72 has been activated (or whichever enable switch was initially activated first, if they are both concurrently activated).

FIG. 5 illustrates an alternative manner of incorporating load cell 84 into control 54. In the configuration of FIG. 5, load cell 84 is mounted externally of handle 78. More specifically, load cell 84 is rigidly coupled to post 80 on one end and rigidly coupled to litter 28 on an opposite end. Post 80, in turn, is mounted to litter 28 in a manner that enables it to flex, pivot, or otherwise undergo a relatively small amount of displacement. A user exerting horizontal or vertical forces on handle 78 will therefore cause a horizontal or vertical strain to be exerted on the internal strain gauges of load cell 84. As with the configuration of load cell 84 of FIG. 4, load cell 84 of FIG. 5 forwards its outputs to controller 62, which reacts accordingly.

Figure 6:
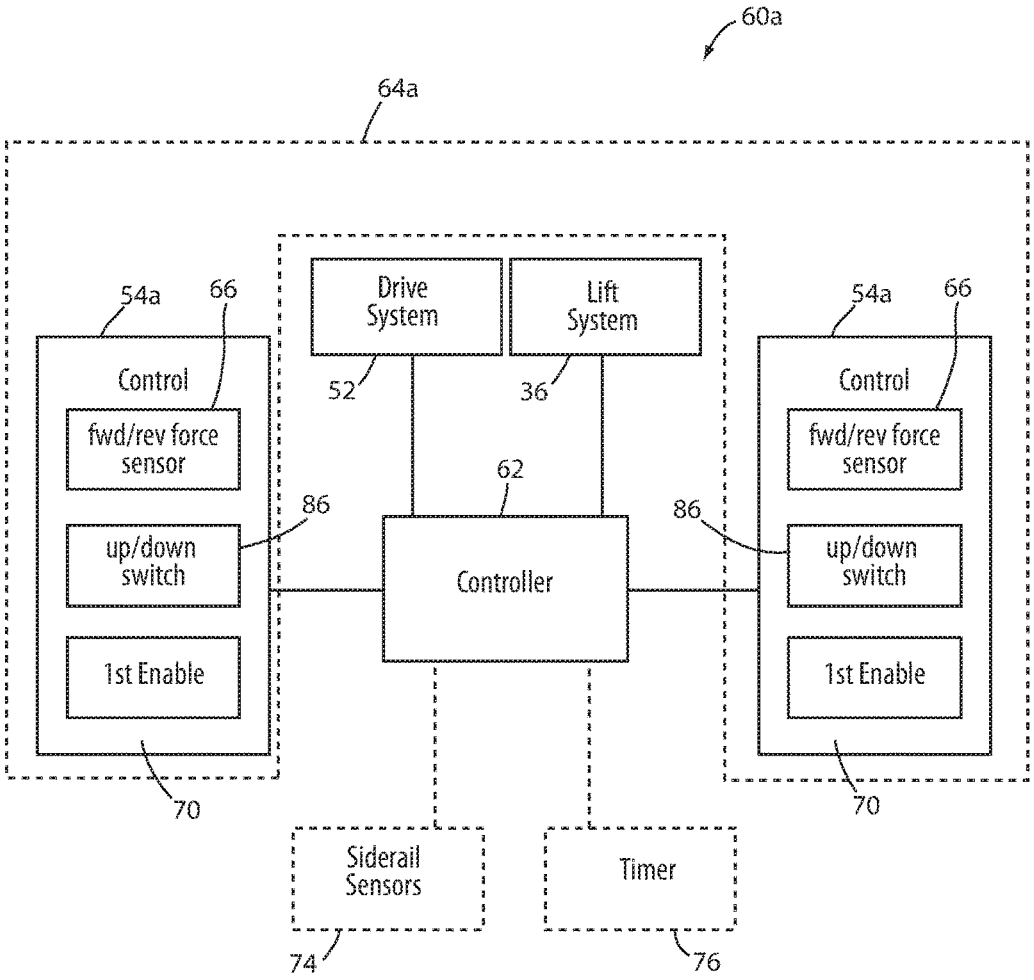
FIG. 6 is a block diagram of a second embodiment of a control system usable with the person support apparatus of FIG. 1.

FIG. 6 illustrates an alternative embodiment of a control system 60*a* that may be used with person support apparatus 20 of FIG. 1. Control system 60*a*, like control system 60, is adapted to provide unitary controls (controls 54*a*) for controlling both drive system 52 and lift system 36. Those components of control system 60*a* that are common to control system 60 are numbered in FIG. 6 with the same numbers as in FIG. 2 and operate in the same manner as discussed above. Those components of control system 60*a* that are not found in control system 60, or that operate in a modified manner, are provided with a new or modified reference number and described in more detail below.

Control system 60*a* differs from control system 60 primarily in that it includes a modified user interface 64*a* having modified controls 54*a*. Controls 54*a* are modified from controls 54 of control system 60 in two primary ways. First, controls 54*a* include an up/down switch 86 instead of an up/down force sensor 68. Second, controls 54a do not include a second enable switch 72. In all other respects, control system 60*a* operates in the same manners described above with respect to control system 60, including any of the aforementioned modifications that may be made to control system 60 and its different embodiments.

Figure 7:
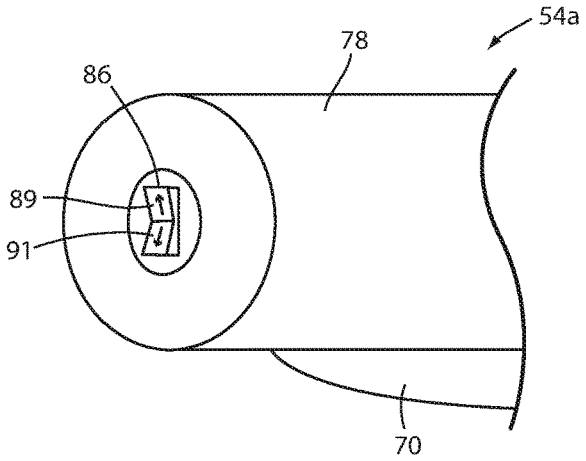
FIG. 7 is a partial perspective view of an illustrative embodiment of one of the controls of the control system of FIG. 6.
Figure 8:
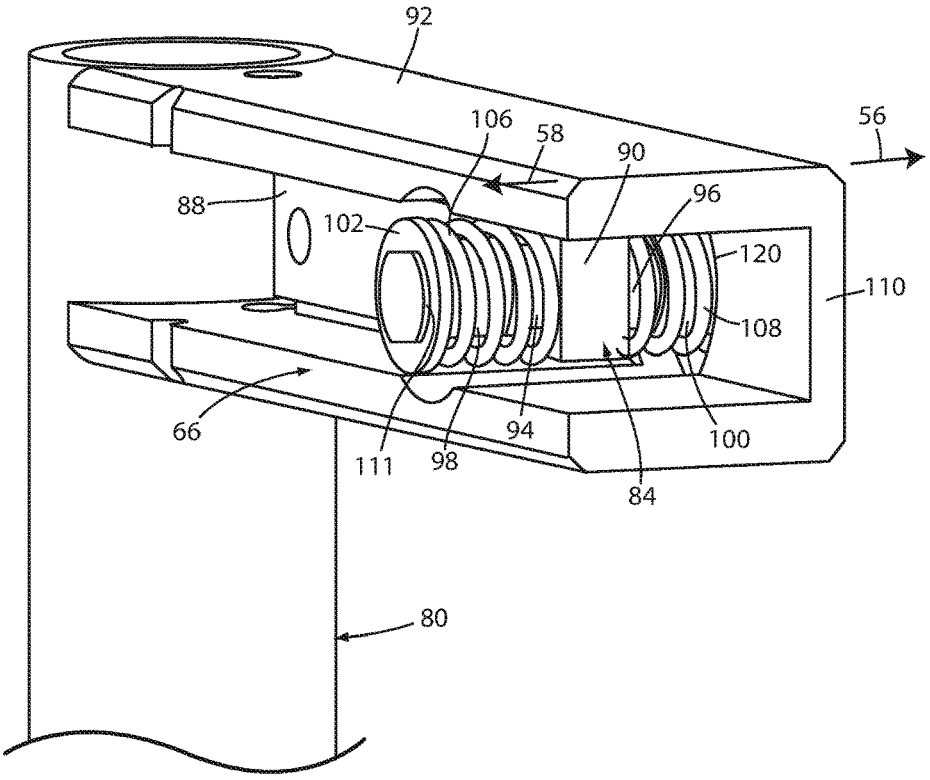
FIG. 8 is a perspective view of a forward and reverse sensor usable with the control systems of FIG. 2 or 6, or with other control systems.
Figure 9:
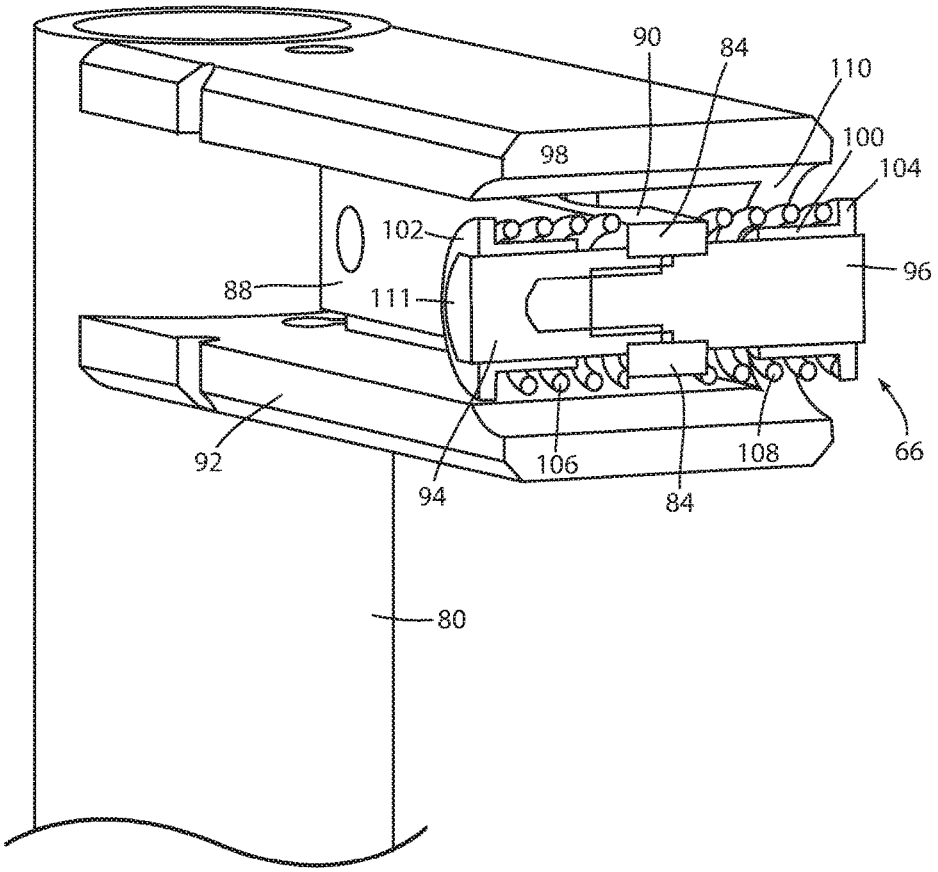
FIG. 9 is a sectional perspective view of the forward and reverse sensor of FIG. 8.

FIG. 7 illustrates one manner in which control 54*a* may be physically configured. As shown therein, up/down switch 86 is mounted to handle 78 generally in the same location that second enable switch 72 is mounted to handle 78 in FIGS. 3-5. Up/down switch 86 includes an upper lobe 89 and a lower lobe 91. Lobes 89 and 91 are adapted to pivot about a substantially horizontal axis running between the lobes 89 and 91. When a user presses on upper lobe 89, this sends a signal to controller 62 indicating that the user would like to raise litter 28. When a user presses on lower lobe 91, this sends a signal to controller 62 indicating that the user would like to lower litter 28. Whether litter 28 is raised or lowered by controller 62 as a result of the user pressing upper lobe 89 or lower lobe 91 will depend upon the specific manner in which controller 62 is programmed. As with control system 60, in some embodiments of control system 60*a*, controller 62 will only raise or lower litter 28 if person support apparatus 20 is not currently being driven by drive system 52. In other embodiments, controller 62 will respond to up and down commands from up/down switch 86 at all times, regardless of whether or not person support apparatus 20 is currently being driven by drive system 52. Switch 86 may alternatively be implemented as a button, or lever, or some other structure where the magnitude of the applied force is not detected.

Control systems 60 and 60*a* can be modified in several additional manners. For example, in some embodiments, control systems 60 or 60*a* are modified to include a single, common enable switch, such as switch 70. In such a modified embodiment, a user who activates the common enable switch will be able to use controls 54 to change the height of litter 28 or drive person support apparatus 20. In one version of such an embodiment, controller 62 allows the user to simultaneously change the height of litter 28 and drive person support apparatus 20 so long as the common enable switch is activated. In another version of such an embodiment, controller 62 only allows the user to perform one of the movement functions (changing the height of the litter 28 or driving person support apparatus 20) at a time. In this latter version, controller 62 is programmed, in at least one embodiment, to select which movement function to control based upon a comparison of the magnitude of any up/down forces versus the magnitude of any forward/reverse forces that are initially applied by the user to control 54. If the up/down forces exceed the forward/reverse forces, controller 62 controls the lift system 36. If the forward/reverse forces exceed the up/down forces, controller 62 controls the drive system 52. A user can switch from controlling one movement function to the other by not applying a force to control 54 for a threshold amount of time (as measured, for example, by timer 76), and then applying force in the direction corresponding to the desired movement function.

Still other modifications may be made to control systems 60 and/or 60*a*. One such additional modification is the removal of both first and second enable switches 70 and 72. In a first version of this modified embodiment, controller 62 allows the user to simultaneously change the height of litter 28 and drive person support apparatus 20 if the user is applying a force on control 54 that has both an up/down component and a forward/reverse component. In a second version of this modified embodiment, controller 62 only allows the user to perform one of the movement functions at a time. The selection of which movement function is carried out by controller 62 is based on whether the user initially applies a greater forward/reverse force or initially applies a greater up/down force, as described above.

In yet another modification of either of control systems 60 and 60*a*, the forward/reverse movement of person support apparatus 20 via drive system 52 is limited by the status of the siderails 46. That is, in such a modified embodiment, controller 62 is programmed to not send any drive commands to drive system 52, based on signals from forward/reverse force sensor 66 of control 54, if one or more of the siderails 46 is in a lowered position. In this embodiment, the status of the siderails is reported to controller 62 via siderail sensors 74. By preventing driving movement of person support apparatus 20 when one or more siderails are lowered, the chances of an occupant of the person support apparatus 20 falling from person support apparatus 20 during its movement from one location to another is reduced.

In another modified embodiment, forward/reverse force sensors 66 are replaced with forward/reverse sensors that do not detect a magnitude of force applied to them. Such sensors may be implemented as buttons, switches, levers, or the like.

In any of the embodiments described herein wherein controller 62 limits the use of controls 54 such that they control only one movement function at a time, including any one or more of the modifications to those embodiments discussed herein, controller 62 may be programmed to utilize timer 76 when switching between the movement functions. For example, in one embodiment, after a user has changed the height of litter 28 using control 54 (or 54*a*), controller 62 does not allow a user to start driving person support apparatus 20 using control 54 (or 54*a*) until after a predetermined time period has passed since the height of the litter 28 stopped moving, as measured by timer 76. Conversely, as another example, after a user has driven person support apparatus 20 using control 54 (or 54*a*) using drive system 52, controller 62 does not allow a user to change the height of litter 28 using control 54 (or 54*a*) until after a predetermined time period has passed since the person support apparatus 20 stopped moving, as also measured by timer 76. In some embodiments, the two predetermined time periods are the same, while in other embodiments, the two predetermined time periods are different.

FIGS. 8-11 show an exemplary manner of implementing forward/reverse force sensor 66 within a handle 78. The implementation of forward/reverse force sensor 66 shown within FIGS. 8-11 may be used with controls 54, or 54*a*, or with still other controls. Indeed, in at least one embodiment, the forward/reverse force sensor 66 of FIGS. 8-11 is implemented in a handle 78 that, unlike the handles of controls 54 and 54*a*, only controls drive system 52, and does not control lift system 36. That is, forward/reverse force sensor 66 may be used on a person support apparatus 20 having a handle for controlling the drive system wherein, if the user wishes to change the height of litter 28, he or she must use a separate control panel (e.g. control panel 48) to change this height, and cannot use the handle having the forward/reverse force sensor 66 of FIGS. 8-11 because that handle does not include an up/down force sensor 68. The forward/reverse force sensor of FIGS. 8-11 can be used in still other manners as well.

Figure 10:
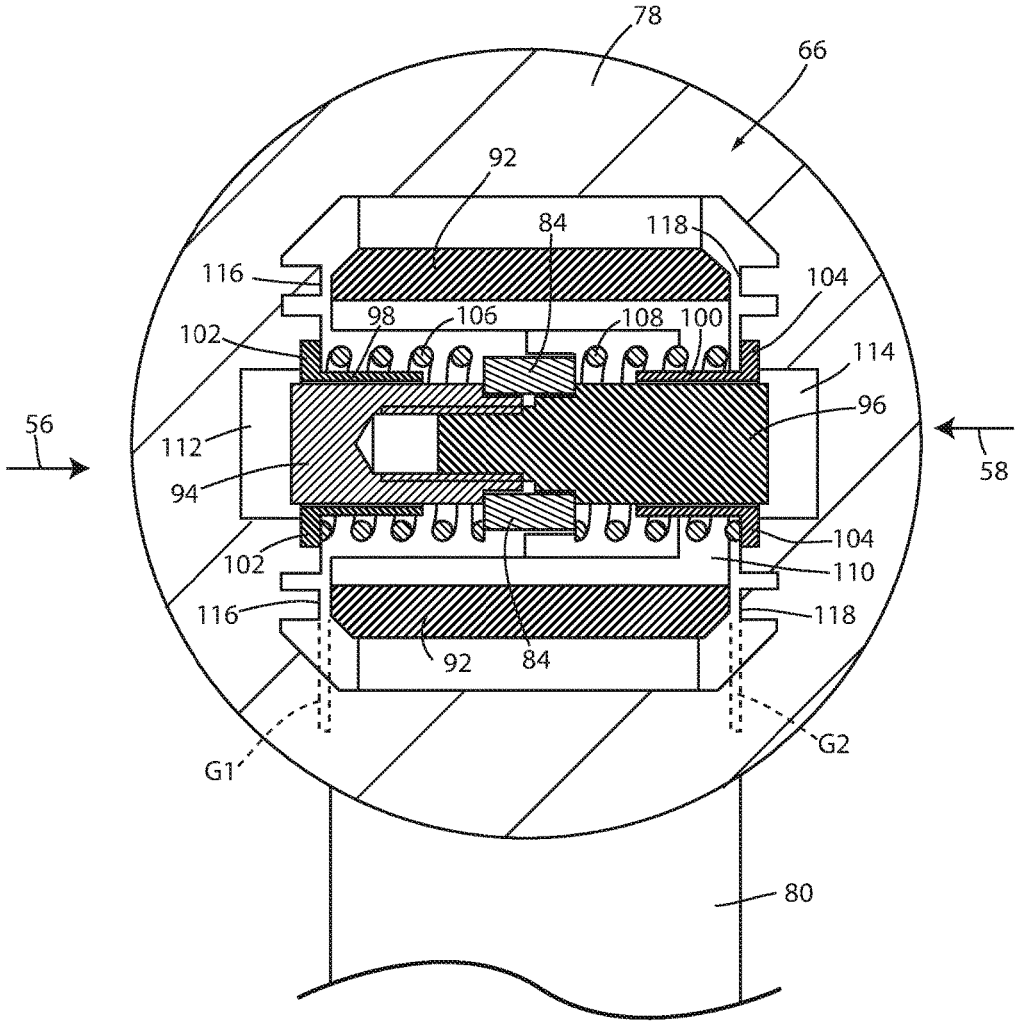
FIG. 10 is a sectional end view of the forward and reverse sensor of FIG. 8 shown with a handle coupled to the forward and reverse sensor.
Figure 11:
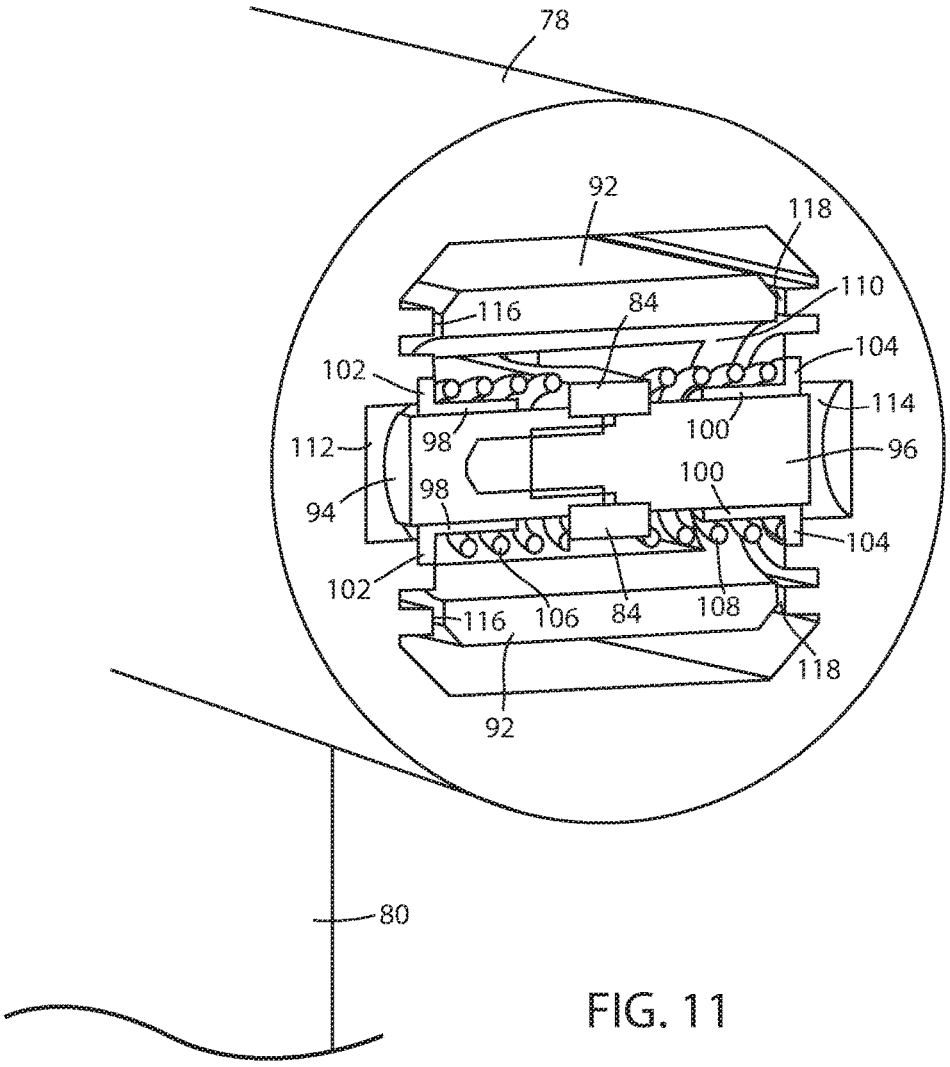
FIG. 11 is sectional perspective view of the forward and reverse sensor of FIG. 8 shown with the handle coupled to the forward and reverse sensor.

As can be seen in FIGS. 8-11, forward/reverse force sensor 66 includes a load cell 84 having a first end 88 and a second end 90. First end 88 is fixedly secured to a handle support 92 while second end 90 is allowed to move when subjected to forces in the forward or reverse directions 56 or 58 that are of sufficient magnitude, as will be discussed in greater detail below. Handle support 92 is fixedly coupled to post 80 and provides a structure to which handle 78 is secured. For clarity, handle 78 has been removed from FIGS. 8-9 in order to better illustrate the construction of forward/reverse force sensor 66. Handle 78, however, is shown in FIGS. 10-11.

A first pin 94 is fixedly secured to a rearward side (i.e. facing toward foot end 40) of second end 90 of load cell 84. A second pin 96 is fixedly secured to a forward side (i.e. facing toward head end 38) of second end 90 of load cell 84. First and second pins 94 and 96 are oriented such that their longitudinal axes are coaxial with each other. Because first and second pins 94 and 96 are both fixedly secured to load cell 84, they will move anytime second end 90 of load cell 84 moves, and they will remain stationary whenever second end 90 of load cell 84 remains stationary. A first sleeve 98 is mounted around a distal end of first pin 94 and a second sleeve 100 is mounted around a distal end of second pin 96. First and second sleeves 98 and 100 are not fixedly secured to first and second pins 94 and 96, but instead are mounted so as to be able to slide along their associated pins 94 and 96 in the forward and reverse directions 56 and 58. First and second sleeves 98 and 100 each include a flange 102 and 104, respectively, that is defined at the distal end of each sleeve 98 and 100.

A first spring 106 is wrapped around first pin 94 and abuts against first flange 102 of first sleeve 98 at one end, and against the rearward face of load cell 84 at its other end. Similarly, a second spring 108 is wrapped around second pin 96 and abuts against second flange 104 of second sleeve 100 at one end, and against a forward face of load cell 84 at its other end. First and second springs 106 and 108 are in compression. They are held in compression by flanges 102 and 104, respectively. Flanges 102 and 104, in turn, are prevented from sliding off of pins 94 and 96, respectively, by first and second lips defined on the ends of each pin 94 and 96. First lip 111, which is defined at the end of first pin 94, is visible in FIGS. 8 and 9. The second lip which is defined at the end of second pin 96 is not visible in any of the drawings, but is identical in structure to first lip 111 in all respects other than it is defined on the end of second pin 96, rather than the end of first pin 94.

The first and second lips are defined on first and second pins 94 and 96, respectively, as regions of pins 94 and 96 that have a larger cross sectional area that the main bodies of pins 94 and 96. That is, for the majority of the length of each pin 94 and 96, the pins have generally circularly shaped cross sections. The exception to this is at the distal ends where the lips are defined. At these ends, the cross sectional shape of the pins is non-circularly shaped due to the lips. Further, the area of the cross-section taken at the lips is greater than the area of any of the cross sections taken through the main body of the pins. This greater area defines the lips and prevents sleeves 98 and 100 from sliding off of the pins.

Handle support 92 includes a wall 110 having an aperture 120 defined therein that is aligned with second pin 96. Dimensions of aperture 120 are large enough for a portion of second pin 96 and second sleeve 100 to extend therethrough. Handle 78, when it is attached to forward/reverse force sensor 66, abuts against an outer face of first and second sleeves 98 and 100, as can be seen more clearly in FIG. 10. Handle 78 has two internal openings 112 and 114 that are defined so as to be positioned generally near the distal ends of first and second pins 94 and 96 when handle 78 is mounted to handle support 92. Openings 112 and 114 are defined so that handle 78 does not come into contact with pins 94 or 96 when forces are applied to handle 78 (or when they are absent). Instead, when a force is applied to handle 78 in forward direction 56, handle 78 will transfer that applied forward force to first sleeve 98. In the absence of first spring 106, this forward force would otherwise cause first sleeve 98 to slide along first pin 94 toward load cell 84. However, because of the presence of first spring 106 and its preloaded state, it will resist and substantially prevent any movement of first sleeve 98 in response to applied forces in the forward direction 56 that has a smaller magnitude than the amount of preloading of first spring 106.

This can be more easily understood with respect to an arbitrary example. Suppose, for purposes of discussion, that first spring 106 is pre-compressed with a force of 50 newtons (N). In this preloaded state, first spring 106 exerts a 50 N force against first sleeve 98 in a reverse direction 58. First sleeve 98, as noted above, is prevented from moving away from load cell 84 due to this 50 N force because of first lip 111 of first pin 94. Thus, first lip 111 experiences a 50 N force from first spring 106 and resists this force with an equal and opposite force of 50 N. When a user applies, say, a 30 N force to handle 78 in forward direction 56, this 30 N force will be exerted against first sleeve 98. The result of this 30 N force will be to offload 30 N of force that was previously being exerted by the lip of first pin 94 onto handle 78. In other words, when the 30 N of force is applied to handle 78 in the forward direction 56, first spring 106 will react to this by—instead of applying 50 N of reactionary force against first lip 111, as it previously did—applying 20 N of reactionary force against first lip 111 and 30 N against handle 78. The 30 N of force applied to handle 78 will also be transferred to load cell 84 so that load cell 84 will register a 30 N force applied in forward direction 56.

The preloading of first spring 106 with a force of 50 N therefore will substantially prevent any movement of handle 78, first sleeve 98, and first spring 106 in response to any forward forces applied to handle 78 that are equal to, or less than, 50 N. Only if a user applies a forward force exceeding 50 N will first sleeve 98 slide closer to load cell 84 and first spring 106 will compress. As a result, handle 78 will not move with respect to handle support 92 for any applied forward force that is less than 50 N. Load cell 84, however, will experience the applied forward forces regardless of whether or not they are less than 50 N or more than 50 N. Forward/reverse force sensor 66 therefore is able to sense forward forces applied to it that are both less than and greater than (or equal to) 50 N, and controller 62 will react to such forces accordingly (e.g. by driving drive system 52).

The preloading of first spring 106 allows forward/reverse force sensor 66 to give handle 78 a rigid and immovable feel for all applied forward forces that are less than the preloaded force. This provides a more beneficial feel to the user as he or she pushes on handle 78. Instead of feeling a loose handle 78 that easily moves with respect to handle support 92, the user experiences a handle 78 that feels firmly coupled to handle support 92, and only begins to move with respect to handle support 92 when the applied force exceeds the preloading of spring 106.

As can be seen more clearly in FIGS. 10 and 11, once the applied forward force exceeds the preloading of first spring 106, handle 78 will not be allowed to travel very far before a first internal wall 116 abuts against a handle support 92. Specifically, handle 78 will only be allowed to move the distance of a first gap G1 between internal wall 116 and handle support 92. Once internal wall 116 comes into contact with handle support 92, all additional forward forces applied to handle 78 will be transferred to handle support 92 (and through there to post 80 and to person support apparatus 20), and will not be sensed by load cell 84. This protects load cell 84 from being subjected to forward forces that are greater than the forward force necessary to bring internal wall 116 of handle 78 into contact with handle support 92.

Second pin 96, second sleeve 100, and second spring 108 are constructed in a similar manner to first spring 106, first sleeve 98, and first spring 106. That is, second spring 108 is preloaded to a desired level, and any forces applied to handle 78 in the reverse direction 58 that are less than this preloaded level do not result in any movement of handle 78 with respect to handle support 92. Only if a reverse force is applied that exceeds the preloading of second spring 108 will handle 78 move toward handle support 92. Further, this movement will only continue until a second internal wall 118 of handle 78 comes into contact with handle support 92. As can be seen in FIG. 10, this contact will occur after handle 78 moves across a second gap G2. In some embodiments, gaps G1 and G2 are the same size. Further, in some embodiments, the amount of preloading of first and second springs 106 and 108 are the same. In other embodiments, however, the preloading of first and second springs 106 and 108 may be different in order to give the user a different feel when pushing and pulling on handle 78 in the forward and reverse directions.

Figure 12:
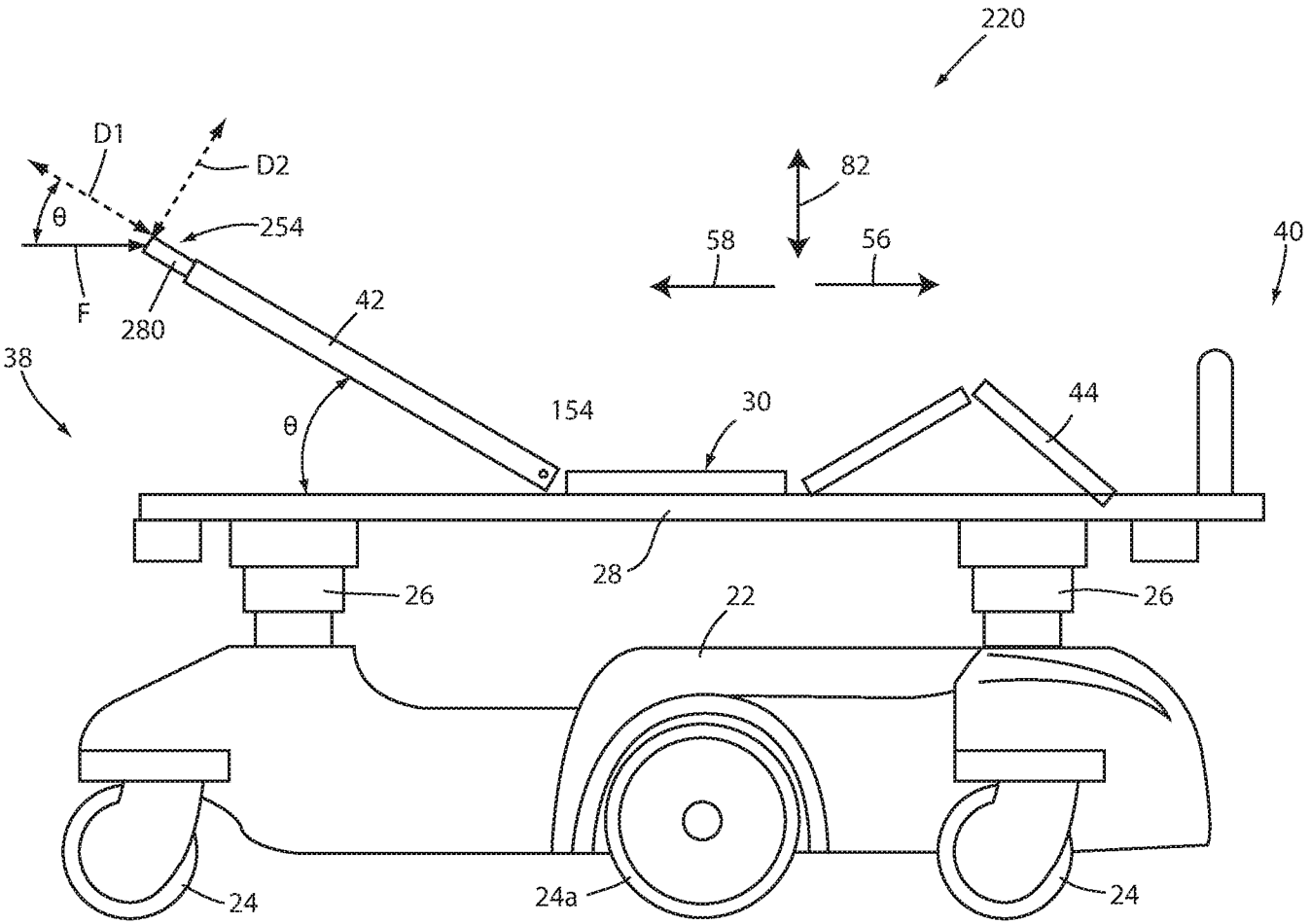
FIG. 12 is a side elevation view of a person support apparatus according to a second embodiment.

FIG. 12 illustrates a person support apparatus 220 according to another embodiment of the disclosure. Those components of person support apparatus 220 that are the same as, or substantially similar to, components of person support apparatus 20 are labelled with the same reference number and, unless otherwise explicitly stated below, operate in the same or a substantially similar manner to the components of person support apparatus 20. Those components of person support apparatus 220 that are modified from comparable components of person support apparatus 20 have been provided with the same reference number increased by a value of 200. Those components of person support apparatus 220 that are new have been provided with a new reference number.

Person support apparatus 220 differs from person support apparatus 20 primarily in that person support apparatus 220 includes a user interface 264 that is mounted in a different location than user interface 64 of person support apparatus 20. User interface 264 is mounted to a head end 38 of Fowler section 42 of person support apparatus 220. User interface 264 therefore moves up and down not only as a result of the pivoting of Fowler section 42 about a generally horizontal pivot axis 154, but also as a result of the raising and lowering of litter 28 due to the action of lifts 26. Horizontal pivot axis 154 extends into and out of the plane of FIG. 12.

Figure 13:
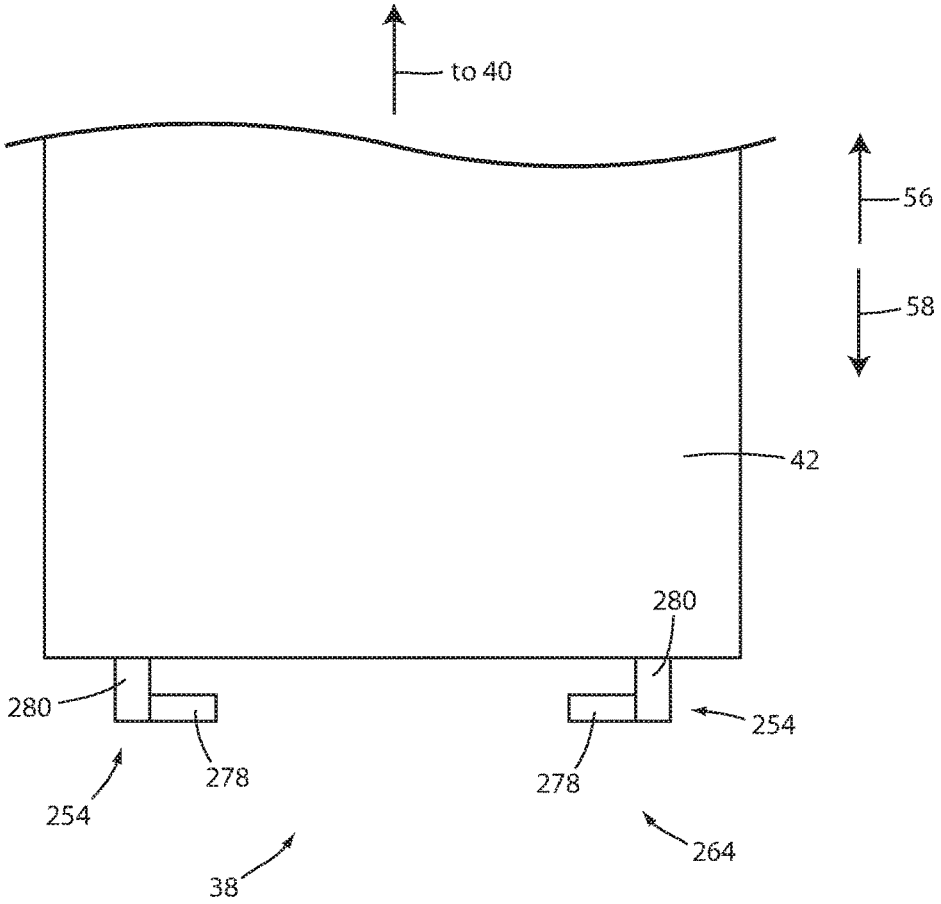
FIG. 13 is a partial plan view of a Fowler section of the person support apparatus of FIG. 12.

As shown more clearly in FIG. 13, user interface 264 includes a pair of user controls 254, one of which is mounted generally toward a right side of Fowler section 42 and one of which is mounted generally toward a left side of Fowler section 42. User controls 254 each include a post 280 and a handle 278. Post 280 and handle 278 are the same as, and operate in the same manner as, any of the embodiments of posts 80 and handles 78 discussed previously with the exception that posts 280 are not mounted in a substantially vertical orientation, such as posts 80. Instead, posts 280 are mounted such that their orientation varies with the pivoting of Fowler section 42. Because of the changing orientations of posts 280, the control system that is used with user controls 254 (such as, but not limited to, control system 60 or control system 60*a*) is modified to include an angle sensor (not shown) that senses an angle A of Fowler section 42 and reports this angle to controller 62. The angle sensor may be any conventional angle sensor, such as, but not limited to, one or more accelerometers built into Fowler section 42, a potentiometer, a level sensor, encoders coupled to the actuator(s) used to change the orientation of Fowler section 42, and/or still other types of angle sensors.

Controller 62 uses the angle measured by the angle sensor to adjust the forces detected by the one or more load cells 84 that are part of user controls 254. More specifically, controller 62 compensates for any misalignment between a forward force F applied by the user to user controls 254 and the sensing axis or sensing axes of the load cells that are integrated into user controls 254. Thus, for example, suppose that user controls 254 are constructed such that they include one or more load cells that are only capable of detecting forces applied in a first direction D1. As can be seen in FIG. 12, first direction D1 is generally parallel to the plane of Fowler section 42 and extends in forward and rearward directions 56 and 58. As a result, if a user applies forward force F in the manner shown in FIG. 12, only the component of forward force F that is parallel to first direction D1 will be sensed by the load cell. Accordingly, the output of the load cell will not accurately represent the magnitude of force F that is applied in forward direction 56. Controller 62 therefore multiplies the output of the load cell(s) by the cosine of the angle θ. The resulting product is then processed and used to control drive system 52 in any of the manners previously discussed.

In some embodiments, user controls 254 include one or more load cells that are capable of detecting forces applied in both first direction D1 and a second direction D2. Second direction D2, as shown in FIG. 12, is oriented generally perpendicular to the plane of Fowler section 42. When a user applies force F in this embodiment, controller 62 may be programmed to calculate the applied force F by performing vector addition of the outputs from the load cells in the directions D1 and D2 and then determining the magnitude of the horizontal component of the resulting vector sum. Alternatively, controller 62 can multiply the output of the load cell(s) by the cosine of the angle θ.

Although not shown in FIGS. 12 and 13, user controls 254 include, in at least some embodiments, one or more first enable switches 70 that must be activated in any of the manners previously described before the user will be able to control drive system 52 using user controls 254.

In addition, user controls 254 may be modified in some embodiments to not only control the forward and reverse movement of drive system 52, but also to control lift system 36. In some of these embodiments, user controls 254 include one or more second enable switches 72 that must be enabled before lift system 36 can be controlled by user controls 254. In others of these embodiments, user controls 254 include one or more up/down switch(es) 86 that must be activated before lift system 36 can be controlled by user controls 254. Regardless of whether or not second enable switches 72 or up/down switches 86 are used (or some variant thereof), the control system (60, 60*a*, etc.) raises and lowers the litter 28 based upon the amount of force applied on user controls 254 in vertical direction 82. Accordingly, because of the changing orientation of user controls 254 when Fowler section 42 pivots, controller 62 uses the appropriate trigonometric calculation to process the load cell outputs based on angle A in order to determine the vertical component of applied force F.

In sum, user controls 254 can be used with any of the control systems 60, 60*a* described above, including the various modifications described above, in order to allow the user to control the propulsion of person support apparatus 220 and/or the raising/lowering of litter 28 of person support apparatus 220.

It will further be understood that various additional modifications may be made to person support apparatus 220 and user controls 254. For example, although user controls 254 have been described as having load cells that measure force components in directions D1 and/or D2, it will be understood that directions D1 and/or D2 can vary from that shown in FIG. 12. In some embodiments, person support apparatus 220 is modified so as to not include any litter or frame 28. Instead, the sections of the deck 30 are supported directly on each other and/or lifts 26. Still further, user controls 254 are constructed, in at least some embodiments, with the internal components shown in FIGS. 8-10. In other embodiments, different internal constructions can be utilized for detecting the user applied forces.

Various additional alterations and changes beyond those already mentioned herein can be made to the above-described embodiments. This disclosure is presented for illustrative purposes and should not be interpreted as an exhaustive description of all embodiments or to limit the scope of the claims to the specific elements illustrated or described in connection with these embodiments. For example, and without limitation, any individual element(s) of the described embodiments may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Any reference to claim elements in the singular, for example, using the articles "a," "an," "the" or "said," is not to be construed as limiting the element to the singular.

What is claimed is:

1. A person support apparatus comprising:

a base;

a plurality of wheels coupled to the base;

a drive system coupled to at least one of the wheels to drive the person support apparatus in a forward and reverse direction;

a support surface adapted to support thereon an occupant of the person support apparatus;

a lift system adapted to adjust a height of the support surface with respect to the base;

a first control located at a first location on the person support apparatus, the first control in communication with the drive system and the lift system, the first control adapted to control the drive system in response to forward forces applied to the first control, and the first control adapted to raise the lift system in response to an upward force applied to the first control and to lower the lift system in response to a downward force applied to the first control; and a control panel located at a second location on the person support apparatus different from the first location, the control panel including a second control adapted to control a height of the lift system.

2. The person support apparatus of claim 1 further including a litter mounted on top of the lift system such that the lift system adjusts the height of the litter with respect to the base, wherein the support surface is mounted on top of the litter.

3. The person support apparatus of claim 2 wherein the first control includes a handle positioned at the litter, the handle moving upward and downward with the litter.

4. The person support apparatus of claim 1 wherein the first control only controls the lift system in response to the upward or downward forces at times when the drive system is not driving the at least one of the wheels.

5. The person support apparatus of claim 1 further including an enable switch that must be activated before the drive system will respond to the forward or reverse forces applied to the first control and before the lift system will respond to the upward or downward forces applied to the first control.

6. The person support apparatus of claim 1 wherein the first control includes a right handle and a left handle, and the person support apparatus further includes a first enable switch and a second enable switch mounted to the right handle, and a third enable switch and a fourth enable switch mounted to the left handle, wherein either the first or third enable switch must be activated before the drive system will respond to forward or reverse forces applied to either of the right or left handles, and wherein the second or fourth enable switch must be activated before the lift system will respond to upward or downward forces applied to either of the right or left handles.

7. The person support apparatus of claim 2 further including:

a plurality of siderails coupled to the litter, each of the siderails being movable between a raised position and a lowered position; and a plurality of siderail sensors, each siderail sensor adapted to detect if a corresponding one of the siderails is in the raised position;

wherein the lift system is configured to not respond to upward or downward forces applied to the first control unless all of the siderail sensors indicate that the siderails are in their raised positions.

8. The person support apparatus of claim 1 further including a timer adapted to start counting when the drive system stops driving the at least one of the wheels, wherein the lift system is configured to not respond to the upward or downward forces applied to the first control until after the timer reaches a threshold.

9. The person support apparatus of claim 1 wherein the first control includes a load cell adapted to detect all of the forward, reverse, upward, and downward forces.

10. The person support apparatus of claim 1 wherein the lift system adjusts the height of the support surface at a constant speed in response to upward or downward forces applied to the first control, and the drive system drives the at least one of the wheels in a manner that varies with a magnitude of the forward or reverse forces applied to the first control.

11. A person support apparatus comprising:

a base;

a plurality of wheels coupled to the base;

a drive system coupled to at least one of the wheels to drive the person support apparatus in a forward direction;

a support surface adapted to support thereon an occupant of the person support apparatus;

a lift system adapted to adjust a height of the support surface with respect to the base;

a controller in communication with the drive system and the lift system; and a control in communication with the controller, the control adapted to detect forward forces, upward forces, and downward forces applied to the control, wherein the controller compares a magnitude of the forward forces to magnitudes of the upward and downward forces and commands the drive system to drive the at least one of the wheels if the magnitude of the forward forces exceeds the magnitudes of the upward and downward forces.

12. The person support apparatus of claim 11 wherein the controller commands the lift system to change a height of the support surface if the magnitude of the upward or downward forces exceeds the magnitude of the forward forces.

13. The person support apparatus of claim 12 wherein the controller pauses for first predetermined amount of time before switching from commanding the lift system to change the height of the support surface to commanding the drive system to drive the at least one of the wheels; and wherein the controller pauses for a second predetermined amount of time before switching from commanding the drive system to drive the at least one of the wheels to commanding the lift system to change the height of the support surface, wherein the first and second predetermined amounts of time are different.

14. The person support apparatus of claim 12 further including a litter mounted on top of the lift system such that the lift system raises and lowers a height of the litter, the support surface being mounted on top of the litter.

15. The person support apparatus of claim 14 wherein the control includes a handle positioned on the litter, the handle moving upward and downward with the litter.

16. The person support apparatus of claim 14 further including:

a plurality of siderails coupled to the litter, each of the siderails being movable between a raised position and a lowered position; and a plurality of siderail sensors, each siderail sensor adapted to detect if a corresponding one of the siderails is in the raised position;

wherein the controller commands the lift system to change the height of the support surface only if both of the following conditions are met: (1) the magnitude of the upward or downward forces exceeds the magnitude of the forward forces, and (2) the siderail sensors indicate that the siderails are in their raised positions.

17. A person support apparatus comprising:

a base;

a plurality of wheels coupled to the base;

a drive system coupled to at least one of the wheels to drive the person support apparatus in a forward and reverse direction;

a support surface adapted to support thereon an occupant of the person support apparatus;

a control for controlling the drive system, the control including a handle, a handle support, and a force sensor adapted to detect a magnitude of forward or reverse user-supplied force applied to the handle, wherein the handle is biased with a preloaded force such that the handle does not move with respect to the force sensor when the user-supplied force is applied to the handle until the user-supplied force exceeds the preloaded force, and when the user-supplied force exceeds the preloaded force but is less than a maximum force, the user-supplied force shrinks a gap between the handle and the handle support, and when the user-supplied force exceeds the maximum force, the handle abuts against the handle support and any portion of the user-supplied force that exceeds the maximum force is offloaded from the force sensor to the handle support; and a controller in communication with the drive system, the controller adapted to control the drive system in response to the user-supplied force applied to the handle of the control, and to not control the drive system in response to any portion of the user-supplied force that exceeds the maximum force.

18. The person support apparatus of claim 17 wherein the force sensor is positioned inside of the handle.

19. The person support apparatus of claim 18 wherein the force sensor is mounted to the handle support.

20. The person support apparatus of claim 19 wherein the handle is adapted to move with respect to the handle support when the user-supplied force is applied to the handle and exceeds the preloaded force but is less than the maximum force.

21. The person support apparatus of claim 20 wherein the handle is mounted to a pre-loaded spring and the pre-loaded spring has one end in abutment with the force sensor.

22. The person support apparatus of claim 21 further including a second force sensor mounted within the handle, the second force sensor adapted to detect upward or downward forces applied to the handle.

23. The person support apparatus of claim 22 wherein the person support apparatus includes a lift system adapted to adjust a height of the support surface with respect to the base, and the controller is adapted to control the lift system based upon outputs from the second force sensor.

* * * * *